US007128588B2

(12) United States Patent
Hu et al.

(10) Patent No.: US 7,128,588 B2
(45) Date of Patent: Oct. 31, 2006

(54) ELECTRICAL CONNECTOR WITH LOCKING/UNLOCKING MEANS

(75) Inventors: Jin-Kui Hu, Kunshan (CN); Guo-Hua Zhang, Kunshan (CN); Zi-Qiang Zhu, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/317,488

(22) Filed: Dec. 23, 2005

(65) Prior Publication Data

US 2006/0141845 A1 Jun. 29, 2006

(30) Foreign Application Priority Data

Dec. 25, 2004 (CN) ..... 2004 1 0065938

(51) Int. Cl.
*H01R 13/62* (2006.01)

(52) U.S. Cl. ..... 439/159; 439/607

(58) Field of Classification Search ..... 439/159, 439/607

See application file for complete search history.

(56) References Cited

U.S. PATENT DOCUMENTS 6,332,790 B1 * 12/2001 Ishikawa et al. ..... 439/157
6,655,972 B1 * 12/2003 Sato ..... 439/159
6,663,403 B1 * 12/2003 Hsu ..... 439/159
6,902,432 B1 6/2005 Morikawa et al.
6,916,189 B1 * 7/2005 Weng ..... 439/159
2004/0014342 A1 * 1/2004 Yu et al. ..... 439/159

* cited by examiner

*Primary Examiner*—Tho D. Ta
*Assistant Examiner*—Larisa Tsukerman
(74) *Attorney, Agent, or Firm*—Wei Te Chung

(57) ABSTRACT

An electrical connector (100) adapted for mating with a complementary connector (6), includes an insulative housing (1) defining a number of channels (12) and grooves (15), a number of terminals (2) received in the channels, a pair of locking/unlocking means (3) retained in the grooves, a latch cooperating with locking/unlocking means for engaging/disengaging with the complementary connector and a metal shell (5). The locking/unlocking means includes a spring (32), a moveable member (30) defining a guiding slot (300) and a guiding pole (31) slidable in the guiding slot by exerting twice push operations, the complementary connector can be engaged with and disengaged from the connector due to displacement of the guiding pole in the guiding slot.

14 Claims, 7 Drawing Sheets

ELECTRICAL CONNECTOR WITH LOCKING/UNLOCKING MEANS

BACKGROUND OF THE INVENTION

1. Field of the Invention

The present invention relates to an electrical connector, and particularly to a USB connector with locking/unlocking means for detachably mating with a complementary connector.

2. Description of Related Art

A conventional USB (Universal Serial Bus) connector for mating with a mating connector is described in U.S. Pat. No. 6,902,432. The USB connector 10 comprises a jack 15 mating with a plug 40. The jack 15 comprises a shield shell 16 and a plurality of jack terminals 35 mounted in the shield shell 16. The plug 40 includes a shield case 41 and a plurality of plug terminals fitted into the shield shell 16 for electrically connecting with the jack terminals 35. The shield shell comprises an upper wall 16*a*, a tongue piece 18 protruding downwardly from the upper wall 16*a*, and a pair of contact portions 19 symmetrically formed on both sides of the tongue piece 18. A U-shaped groove 20 is defined by punching along a ridge line of each contact portion 19 between the contact portion 19 and the upper wall 16*a*. The shield case 41 has a depression 45 defined on an upper surface thereof for receiving the tongue piece 18. A pair of claws 51 protrude upwardly from the upper surface of the shield case 41 for engaging with the grooves 20 when the plug 40 is inserted into the jack 15.

The plug 40 would be firmly fitted in the jack 15 due to the engagement among the tongue piece 18 and the depression 45, the claws 51 and the grooves 20. However, there is no locking/unlocking means, and the claws 51 of the plug 40 could not be depressed downwardly to escape from the grooves 20 easily, therefore, the plug 40 is hard to be pulled out from the jack 15. The structure is easy to be damaged when an excessive force is exerted thereon for pulling the plug 40 out of the jack 15.

With development of a digital camera or the likes in which a USB connector is always employed, an improved USB connector is appeared. The connector has a longer mating portion compared to the conventional connector and thus, it is much harder to pull a complementary connector out due to the long length of the mating portion thereof.

Hence, an improved USB connector having a locking/unlocking means is required to overcome the disadvantages of the related art.

SUMMARY OF THE INVENTION

A primary object of the present invention is to provide an electrical connector with locking/unlocking means to reduce an exerted force during the process of pulling out the mating connector.

Another object of the present invention is to provide an electrical connector with a means locking the mated connectors securely and releasing the mated connectors easily.

To achieve the aforementioned objects, an electrical connector adaptable for mating with a mating connector corresponding to the present invention comprises an insulative housing defining a plurality of channels and grooves, a plurality of terminals received in the channels, a pair of locking/unlocking means retained in the grooves, a shell and a latch cooperating with locking/unlocking means for engaging/disengaging with the mating connector. The locking means comprises a spring, a moveable member defining a guiding slot and a guiding pole slidable in the guiding slot to permit a movement of the moveable member between a forward position and a rear position.

The mating connector would be locked or disengaged freely by sliding movement of the guiding pole. It is available to make the exerted force greatly reduced via the locking/unlocking means when the mating connector is inserted into or disengaged from the connector under twice push operations. The structure is thus more strengthened and could be used for certain a long time.

Other objects, advantages and novel features of the invention will become more apparent from the following detailed description of the present embodiment when taken in conjunction with the accompanying drawings.

BRIEF DESCRIPTION OF THE DRAWINGS

FIG. 6 is a perspective view of the electrical connector with a mating connector being partially inserted in.

DETAILED DESCRIPTION OF THE INVENTION

Figure 1:
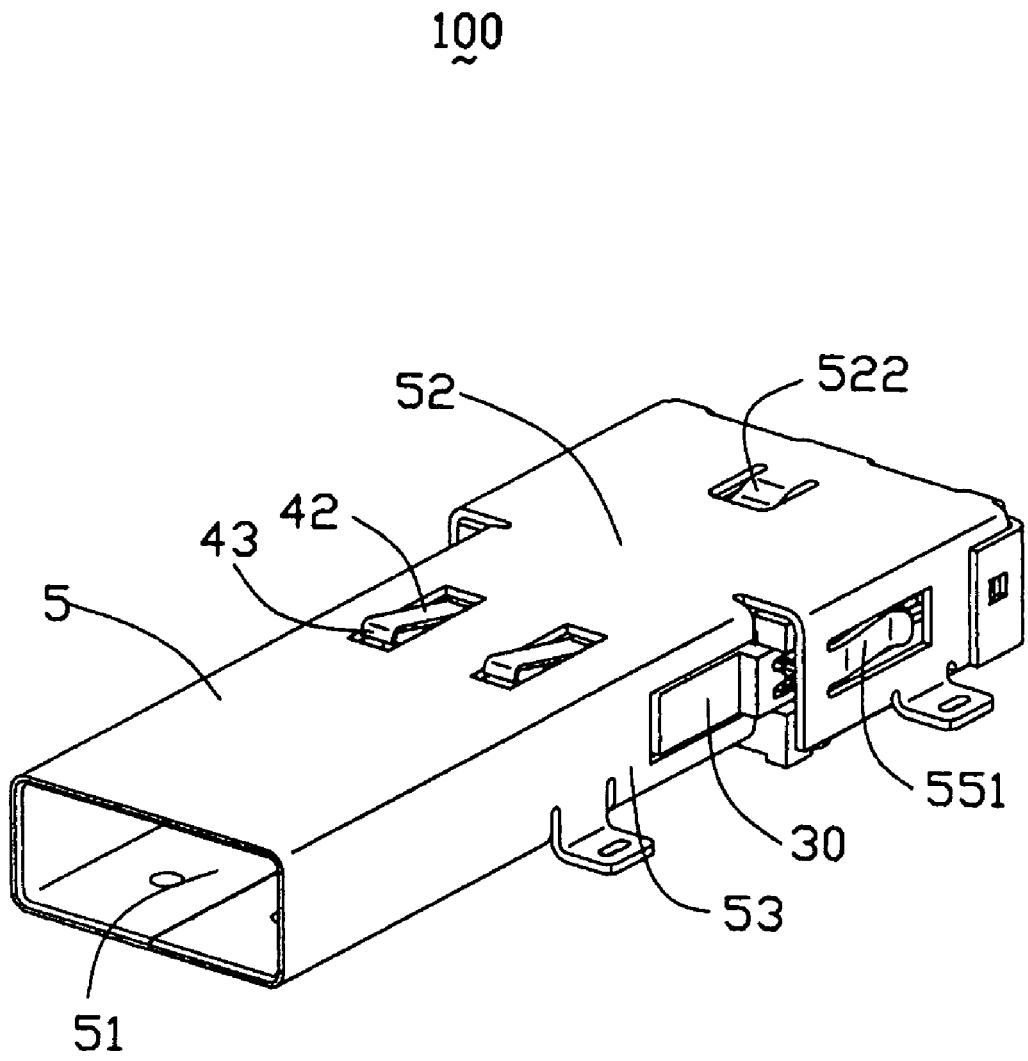
FIG. 1 is a perspective view of an electrical connector according to the present invention.
Figure 2:
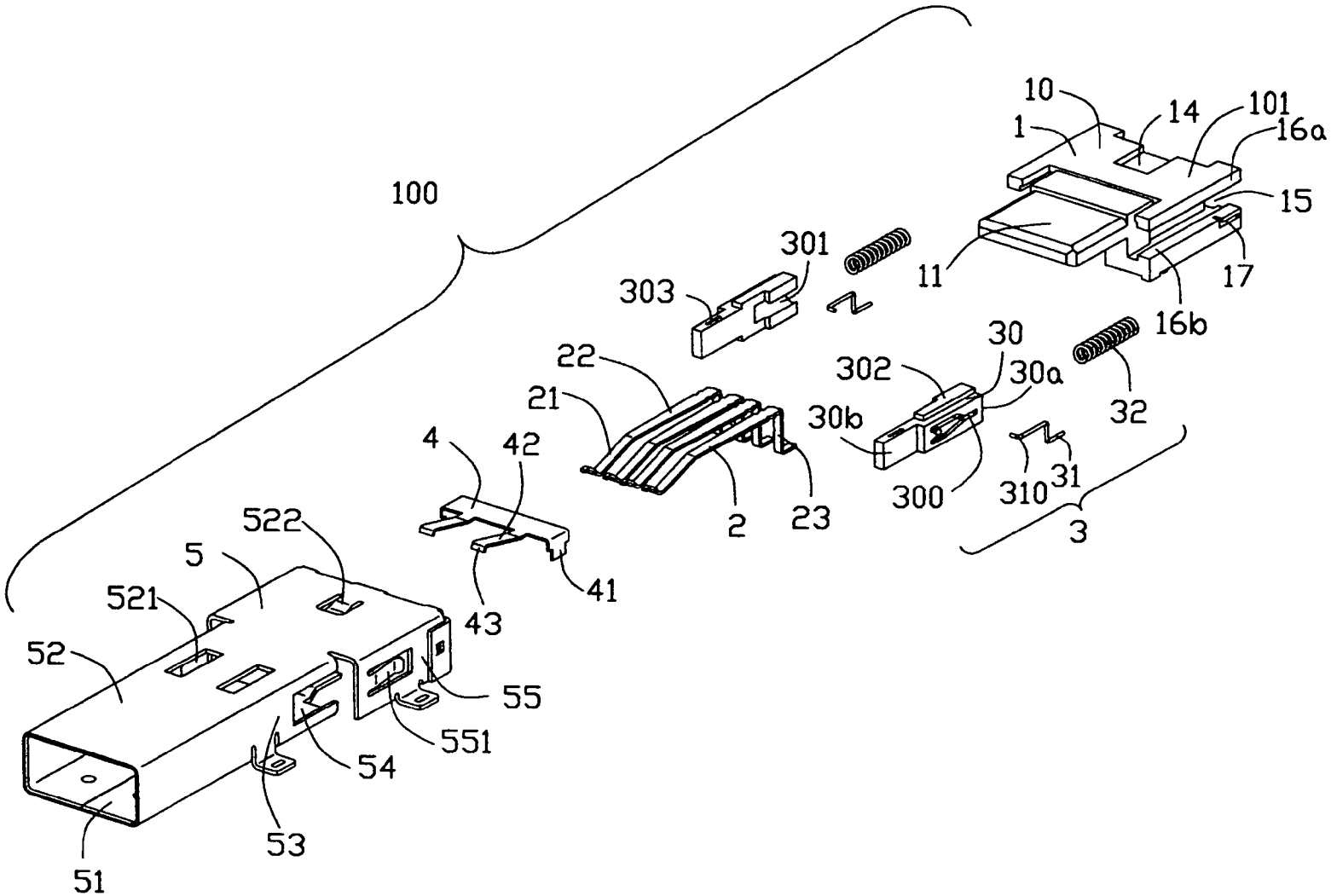
FIG. 2 is an exploded view of the electrical connector.
Figure 3:
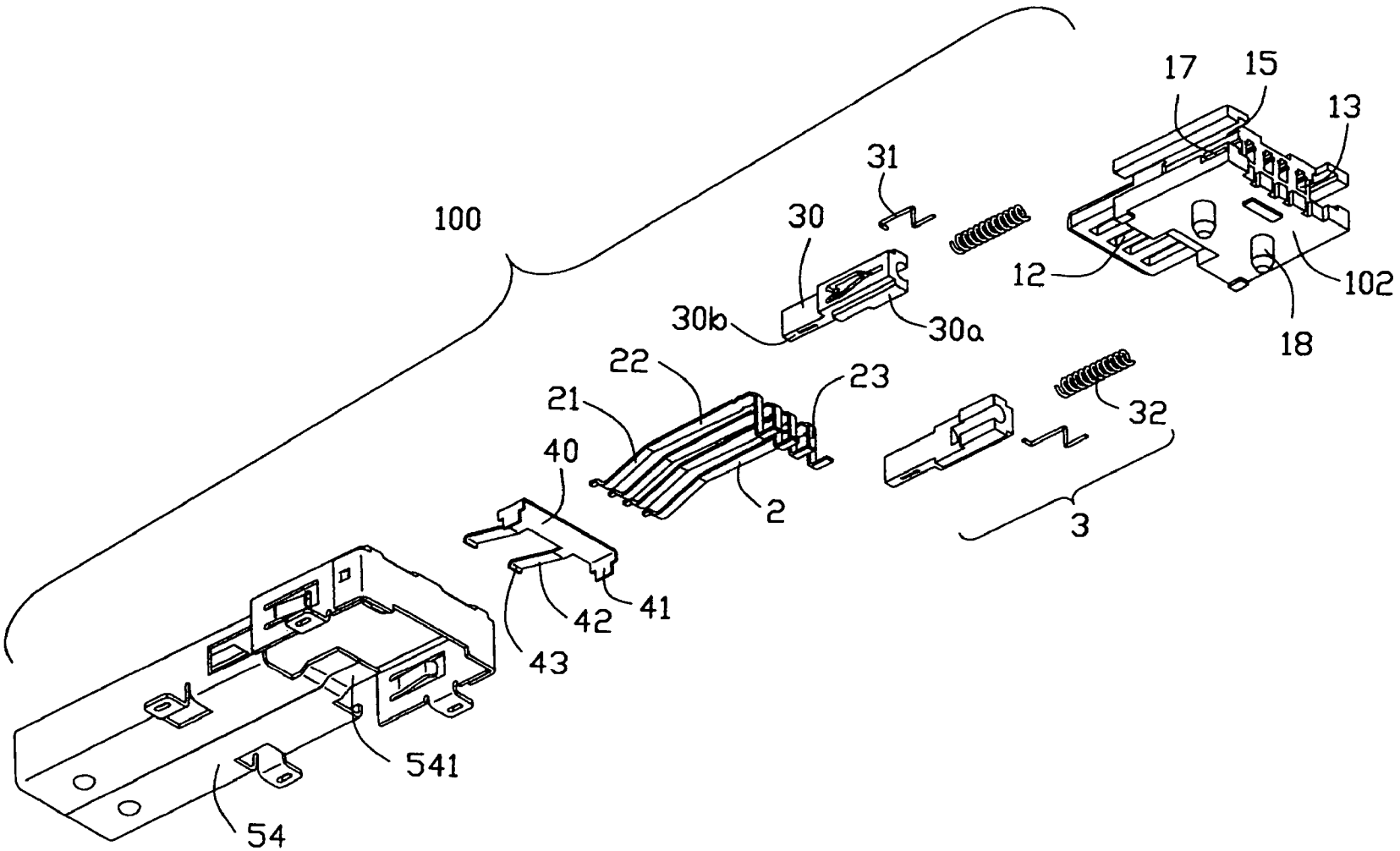
FIG. 3 is another exploded view of the electrical connector.

Referring to FIGS. 1–3, an electrical connector 100 in accordance with the present invention, which is a USB connector in this exemplary embodiment, comprises an insulative housing 1, a plurality of terminals 2, a pair of locking/unlocking means 3 or a push-push means, a latch 4 and a metal shell 5.

The insulative housing 1 comprises a body portion 10 and a rectangular nose portion 11 extending forwardly from the body portion 10. The body portion 10 comprises a top face 101, an opposite bottom face 102, a pair of upper flanges 16*a* protruding laterally from opposite sides of the top face 101, and a pair of lower flanges 16*b* extending laterally from opposite sides of the bottom face 102. The body portion 10 also has a pair of grooves 15 defined between corresponding upper and lower flanges 16*a*, 16*b* for retaining the locking/unlocking means 3. The grooves 15 extend in a longitudinal direction throughout a front surface to a rear surface (not labeled) of the body portion 10. Each lower flange 16*b* has an L-shaped recess 17 defined at a rear end thereof. The body portion 10 defines a rectangular indentation 14 in a centre of the top face 101 thereof. The body portion 10 defines therein a plurality of passageways 13 extending parallel to the grooves 15. The body portion 10 has a pair of posts 18 extending downwardly from the bottom face 102 thereof for guiding the connector 100 to be securely mounted on a PCB (not shown). The nose portion 11 has a plurality of channels 12 defined at a lower surface thereof and communicating with the passageways 13 respectively.

Each terminal 2 has a V-shaped contacting portion 21 for contacting with a mating connector 6, an L-shaped soldering portion 23 used to be soldered onto the PCB, and a connection portion 22 connecting the contacting portion 21 and the soldering portion 23 together.

Figure 4:
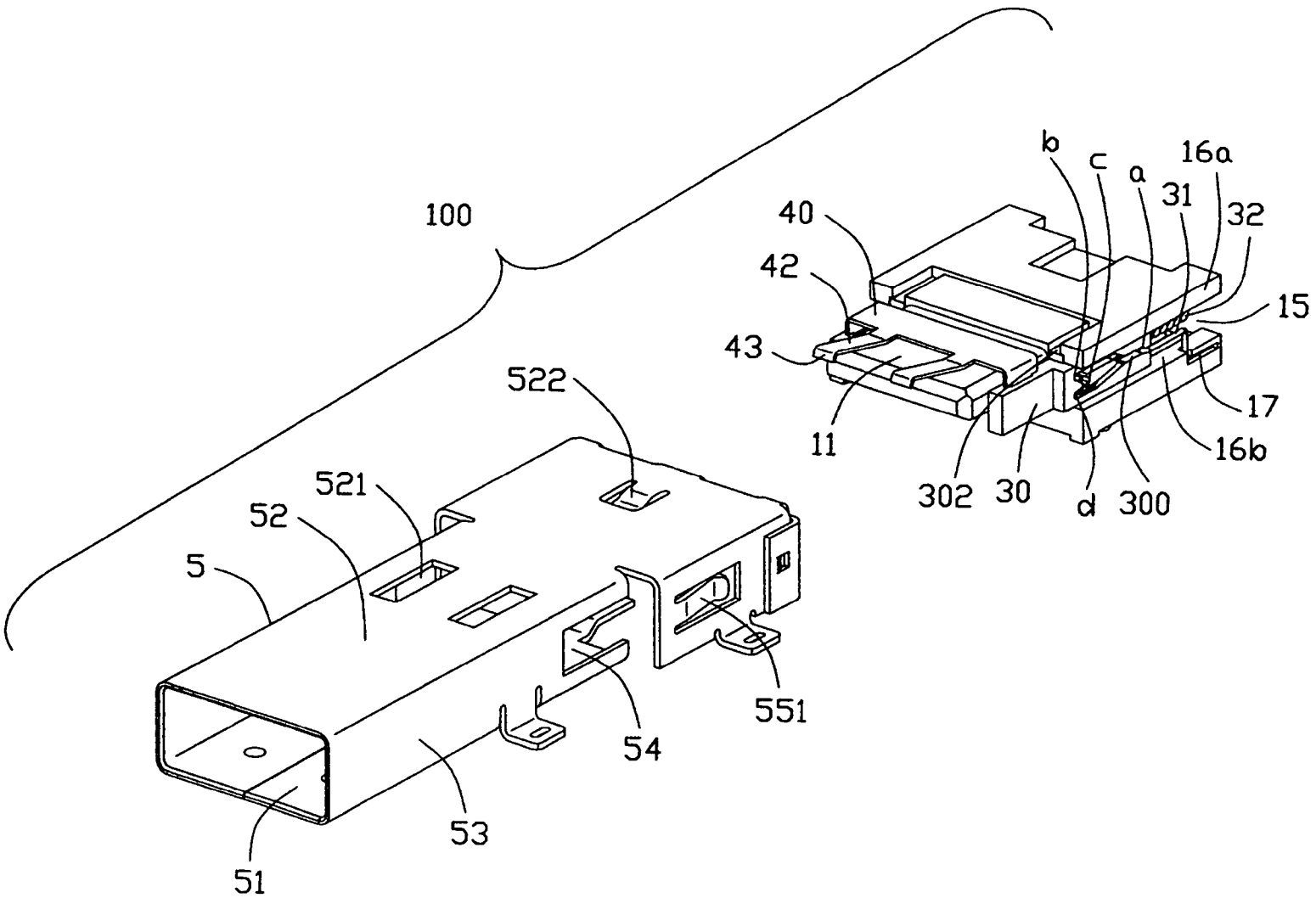
FIG. 4 is a partially exploded view of the electrical connector.
Figure 5:
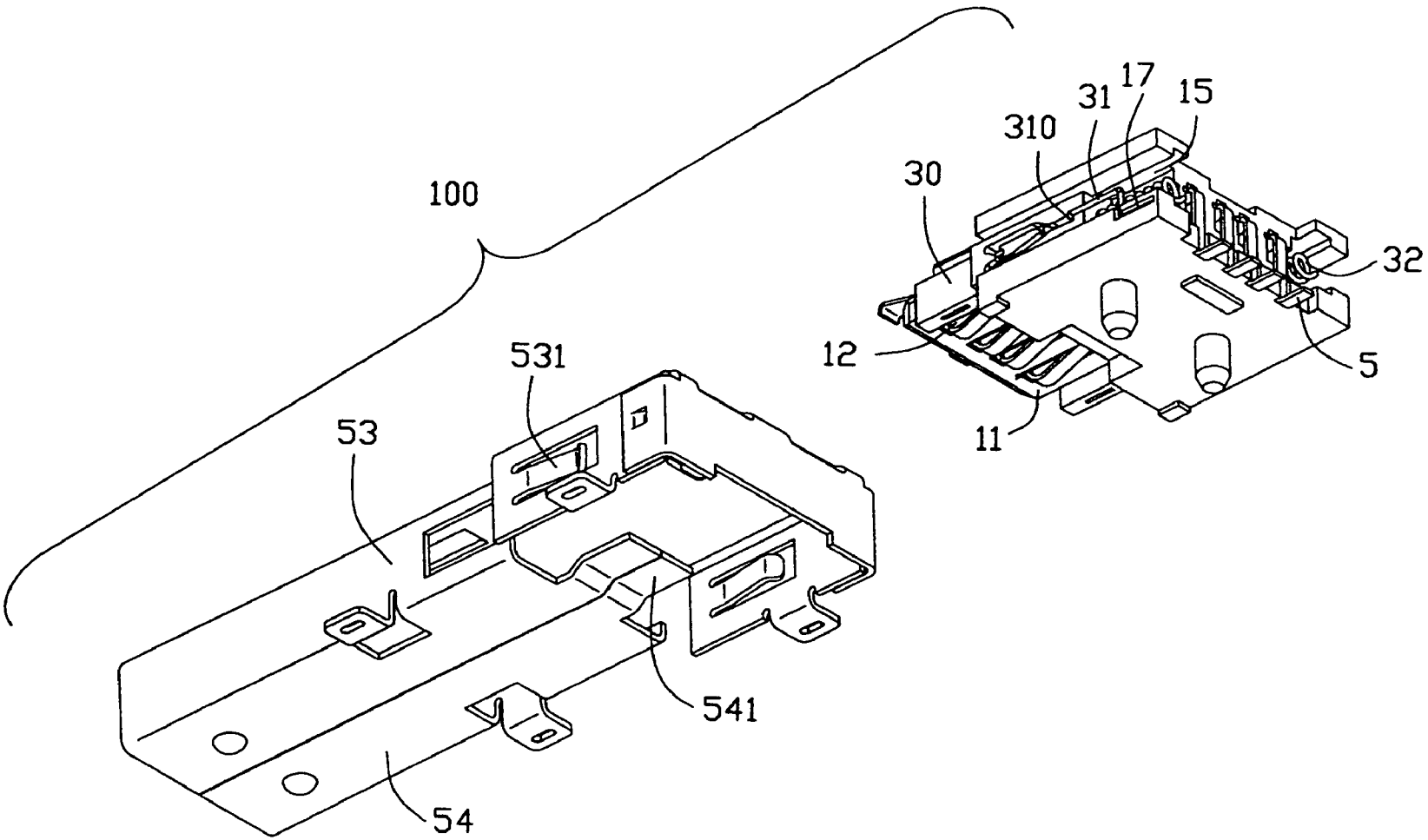
FIG. 5 is another partially exploded view of the electrical connector.
Figure 6:
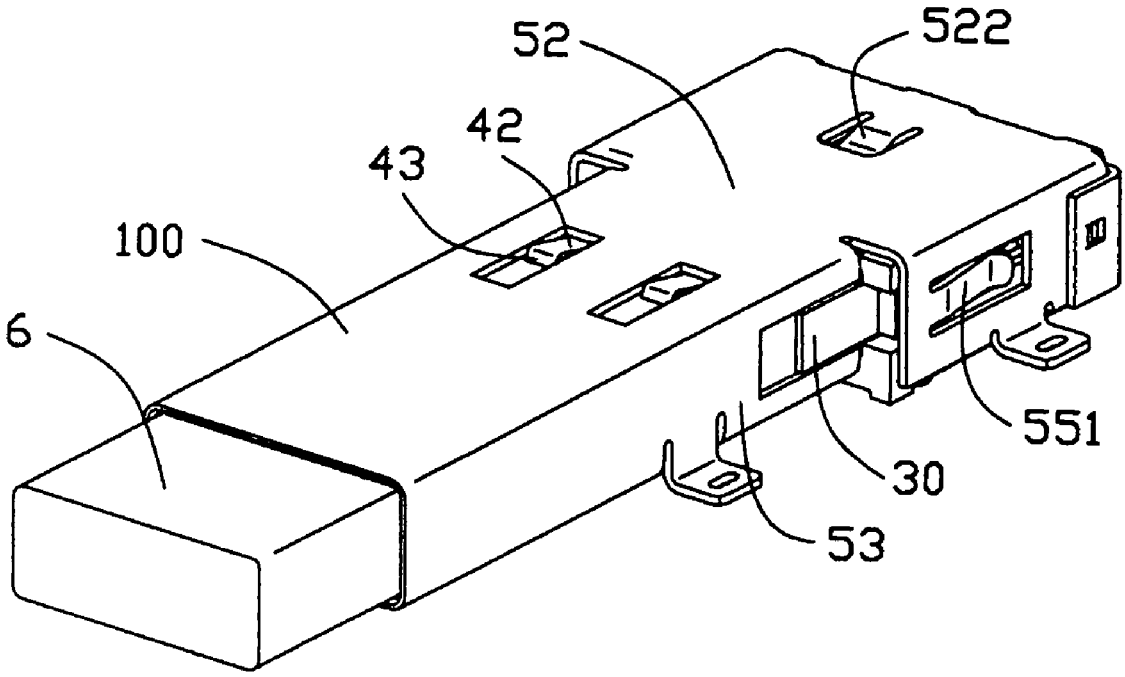
Figure 7:
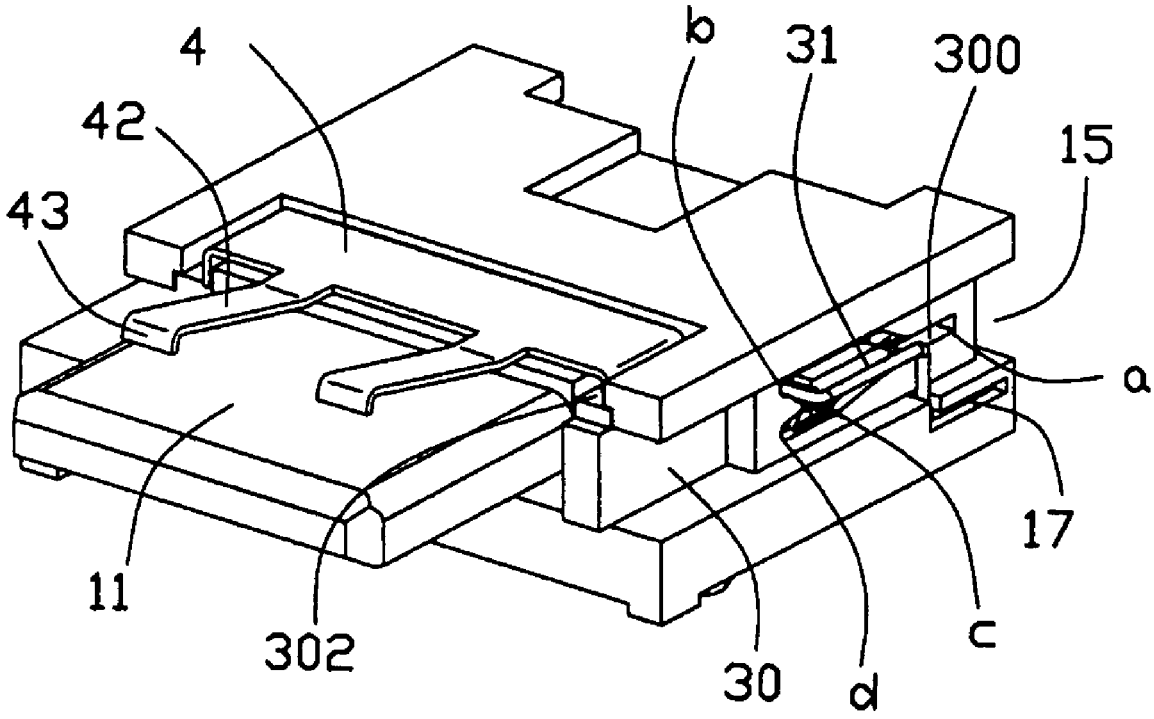
FIG. 7 is a perspective view of the electrical connector with a metal shell being removed when the mating connector is completely inserted in but hasn't been locked.

Each locking/unlocking means 3 comprises a moveable member 30 defining a guiding slot 300, a Z-shaped guiding pole 31 capable of sliding in the guiding slot 300, and a spring 32 mounted on the moveable member 30. The moveable member 30 comprises a body portion 30*a* and a front portion 30*b* extending forwardly from the body portion 30*a*. The guiding slot 300 is defined at an outer surface of the body portion 30*a* and is configured like a lying "Y". Referring to FIG. 4, specifically two ends extending forwardly are defined as points b, d. Another end extending rearwardly is defined as point a. A point c is defined beside the point d. Turn back to FIGS. 1–3, each body portion 30*a* has a receiving hole 301 defined in an inner surface opposite to the guiding slot 300 for receiving the spring 32. A pair of protrusions 302 project outwardly from a top surface and a bottom surfaces of each body portion 30*a*. The front portion 30*b* has a slit 303 defined on a top surface thereof in a longitudinal direction. The Z-shaped guiding pole 31 has a L-shaped hook 310 capable of sliding in the guiding slot 300, with an opposite end fixed in the recess 17.

The latch 4 comprises a pair of inserting portions 41 extending downwardly from two opposite sides thereof, and a pair of elastic arms 42. Each elastic arm 42 extends at an acute angle with respect to an inserting direction of the mating connector 6. A claw 43 for clasping the mating connector 6 is formed at a free end of each elastic arm 42.

The metal shell 5 enclosing the insulative housing 1 is formed as a substantially rectangular case. The metal shell 5 comprises a top wall 52, a pair of periphery walls 53, and a bottom wall 54 opposite to the top wall 52. The walls 52, 53, 54 are connected together to thereby define an opening 51 for retaining the mating connector 6. The metal shell 5 has a pair of periphery beams 55 extending downwardly from a rear portion of two opposite side edges of the top wall 52. The periphery beams 55 and the periphery walls 53 are arranged parallel to each other, but are not located on a same plane. The metal shell 5 has a pair of rectangular apertures 521 corresponding to the elastic arms 42 defined at the top wall 52. A tab 522 is formed at the rear potion of the top wall 52 for engaging with the indentation 14. The pair of periphery beams 55 are respectively provided with a clip 551 for resisting against the guiding pole 31. The bottom wall 54 has an elastic blade 541 projecting inwardly and rearwardly from a rear edge thereof.

Referring to FIGS. 2–5, in assembly, the plurality of terminals 2 are inserted into the corresponding passageways 13, with the contacting portions 21 thereof being received in the corresponding channels 12 and the soldering portions 23 being exposed outside the insulative housing 1. The springs 32 are mounted in the corresponding receiving holes 301. The moveable members 30 together with the springs 32 are inserted into the corresponding grooves 15 from a rear of the body portion 10, with the protrusions 302 thereof being retained between the nose portion 11 and the corresponding flanges 16. The opposed inner surfaces of the flanges 16 are comfortably engaged by the top and bottom surfaces of the moveable member 30. The guiding poles 31 are inserted into the corresponding recesses 17, with the hooks 310 thereof moveably retained in the guiding slots 300. The latch 4 is mounted on the insulative housing 1, with the inserting portions 41 thereof being inserted into the corresponding slits 303 of the locking/unlocking means 3. The metal shell 5 is assembled around the insulative housing 2, with the tab 522 and the elastic blade 541 thereof respectively resisting against the indentation 14 and the bottom of the insulative housing 1 to thereby fasten the insulative housing 1 in the opening 51. Each guiding poles 31 is resisted against by the corresponding clip 551 for preventing itself excursing off the guiding slot 300 during the process of sliding along the guiding slot 300. The elastic arms 42 extend outwardly through the corresponding apertures 521.

Referring to FIGS. 4–7 together with the FIG. 1, in a normal state, each moveable member 30 is located at the front portion of the corresponding groove 15, the hook 310 of the guiding pole 31 is positioned at the point a.

When the mating connector 6 is inserted into the connector 100 from the opening 51, the pair of locking/unlocking means 3 are pushed backwards by the mating connector 6. The hooks 310 slide forwardly along the guiding slot 300 from the point a toward the point b. At the same time, due to the engagement between the inserting portions 41 and the slits 303, the latch 4 would be obliged to move rearwardly together with the moveable members 30. The elastic arms 42 of the latch 4 are resiliently depressed downwardly by the top wall 52 of the metal shell 5 with the claws 43 thereof clasping the mating connector 6. The elastic arms 42 latch with the mating connector 6 finally when the mating connector 6 is substantially engaged with the electrical connector 100. When the mating connector 6 is completely inserted in, each moveable member 30 moves to the rear portion of the groove 15 and the guiding pole 31 is driven to the point b. Due to an elastic force of the compressed spring 32, when no external force is exerted on the mating connector 6, the hooks 310 slide rearwardly from the point b toward the point c freely and fixed at the point c finally. The elastic arms 42 are depressed to the lowest position in a state of clasping the mating connector 6 firmly. The mating connector 6 locks with the electrical connector 100.

When the mating connector 6 needs to release from the electrical connector 100, an external force can be exerted on the mating connector 6 to push the mating connector 6 to move a distance along the insertion direction. Once the hook 310 slides in the guiding slot 300 from the point c and arrives at the point d, the external force can be removed, and then, the hook 310 slides from the point d to the point a due to the elastic force of the spring 32. The latch 4 moves with the locking/unlocking means 3. The elastic arms 42 release from the mating connector 6 when the latch 4 moves till the arms 42 are exposed out of the metal shell 5 from the apertures 521.

It will be understood that the invention may be embodied in other specific forms without departing from the spirit or central characteristics thereof. The present examples and embodiments, therefore, are to be considered in all respects as illustrative and not restrictive, and the invention is not be limited to the details given herein.

What is claimed is:

1. An electrical connector adaptable for mating with a complementary connector, comprising:

an insulative housing having a nose portion extending forwardly therefrom and defining a plurality of channels on a surface of said nose portion, said insulative housing having at least one groove defined on a side thereof;

a plurality of terminals received in said corresponding channels of said insulative housing;

at least one locking/unlocking means received in a corresponding one of said at least one groove, said locking/unlocking means comprising a spring, a moveable member defining a guiding slot and a guiding pole mounted to said insulative housing and slidable in said guiding slot to permit a movement of said moveable member between a forward position and a rearward position;

a latch cooperating with said locking/unlocking means for engaging/disengaging said complementary connector;

a metal shell encasing therein said insulative complementary connector, and cooperating with said latch for allowing said housing and said latch to clasp or release said complementary connector; and wherein said latch has at least a portion extending downwardly therefrom and wherein said each moveable member defines a slit for insertion of said portion.

2. The electrical connector as claimed in claim 1, wherein said insulative housing defines at least a recess and wherein each guiding pole has a hook sliding in the guiding slot and an opposite end fixed in said recess.

3. The electrical connector as claimed in claim 2, wherein said guiding slot is defined at an outer surface of said moveable member and is configured like a lying "Y", said guiding slot having a pair of front points and a rear point.

4. The electrical connector as claimed in claim 3, wherein each moveable member defines a receiving hole for receiving said spring.

5. The electrical connector as claimed in claim 4, wherein said guiding pole slides from said rear point toward an upper front point when said complementary connector is partly inserted into said connector.

6. The electrical connector as claimed in claim 5, wherein said guiding pole slides from the upper front point toward a lower front point of said guiding slot due to an elastic force of said compressed spring after said complementary connector being completely inserted into said connector.

7. The electrical connector as claimed in claim 6, wherein said guiding pole slides from the lower front point toward said rear point when a push force is exerted on said complementary connector.

8. The electrical connector as claimed in claim 1, wherein said latch is formed with at least an elastic arm capable of resiliently depressed and wherein said metal shell defining an aperture for engaging with said at least one elastic arm.

9. The electrical connector as claimed in claim 8, wherein said elastic arm is formed with a claw at a free end thereof.

10. The electrical connector as claimed in claim 8, wherein said metal shell is formed with a clip for resisting against said guiding pole.

11. The electrical connector as claimed in claim 9, wherein said elastic arm of the latch is resiliently depressed downwardly by said metal shell with said claw thereof clasping the complementary connector when the complementary connector engages to said connector.

12. The electrical connector as claimed in claim 9, wherein said latch moves till said elastic arm is exposed out of said metal shell from said aperture when a push force is exerted on the engaged complementary connector.

13. The electrical connector as claimed in claim 1, wherein said insulative housing has a pair of posts extending downwardly therefrom.

14. An electrical connector comprising:

an insulative housing defining a mating portion with a plurality of contacts disposed therein and a mating direction thereof;

a metallic shell enclosing the housing; and a locking/unlocking device back and forth moveable along said mating direction and essentially between locking and unlocking position; wherein said locking/unlocking device is symmetrically arranged with regard to said housing so as to achieve a balanced force distribution for locking/unlocking;

wherein said locking/unlocking device includes a locking arm which is deflectable in a vertical direction perpendicular to mating direction corresponding to back-and-forth movement of the locking/unlocking device along the mating direction;

wherein said metallic shell includes an opening to not only expose said arm for visionary inspection but also deflect said arm and for locking a complementary connector.

* * * * *